United States Patent [19]

Watkins

[11] Patent Number: 5,011,153

[45] Date of Patent: Apr. 30, 1991

[54] GOLF PUTTING AID AND TEACHING DEVICE

[76] Inventor: Thomas H. Watkins, 9513 Steinbeck La., Bakersfield, Calif. 93311

[21] Appl. No.: 552,622

[22] Filed: Jul. 13, 1990

[51] Int. Cl.[5] ..... A63B 69/36

[52] U.S. Cl. ..... 273/186 A; 273/194 A

[58] Field of Search ..... 273/186 A, 194 A, 183 D, 273/183 E, 186 R, 186 C, 186 E, 192, 193 R

[56] References Cited

U.S. PATENT DOCUMENTS

| | | | |
|---|---|---|---|
| 1,759,622 | 5/1930 | Kenney | 273/186 A |
| 2,057,821 | 10/1936 | Costello | 273/194 A |
| 3,360,268 | 12/1967 | Molinari | 273/186 A |

*Primary Examiner*—George J. Marlo

*Attorney, Agent, or Firm*—Jessup, Beecher & Slehofer

[57] ABSTRACT

A golfer's putting aid is demountably secured to the putter head with a rubber band. The invention visually teaches the golfer to keep the putter head at a right angle relative to the sight line the golfer intends to putt the ball along. It is intended to teach the golfer not to twist the putter shaft while putting. The putting aid is a U-shaped bracket formed by a pair of spaced apart parallel fingers extending from a cross brace having a platform. The open ended rectangular cavity formed by the fingers and cross brace is large enough to surround a golf ball lying on the practice green and forms a guideway. There are a pair of spaced apart abutments with anchor posts located on the platform adjacent to the two interior corners of the cavity. The two abutments are vertical and abut against the face of the putter head. The two anchor posts secure the ends of the rubber band which is stretched underneath the cross brace. The stretched rubber band holds both ends of the putter head against the abutments. Both fingers visually exaggerate the angle of the face of the putter relative to the imaginary swing line while practicing one's putting.

12 Claims, 3 Drawing Sheets

GOLF PUTTING AID AND TEACHING DEVICE

BACKGROUND OF THE INVENTION

1. Field of the Invention

Education and demonstration: physical education; golf. Golf teaching device.

Golf practice device amusement devices: miscellaneous ball and club alignment means; alignment means demountably attached to putter head.

Sighting device requiring golfer to look at a point; golf guide putting.

2. Description of the Prior Art

The recreational activity of golfing has continued to attract more and more enthusiasts year after year until it is getting to the point where golf is one of this country's most popular recreational activities. The positive aspects of golfing are that players young and old; men and women; those who are physically fit and those who are not physically fit, can become proficient players and can enjoy the game without having to be conditioned athletes.

The universal characteristic of a competent golfer is to have a consistently good swing when teeing off at the beginning of each hole, when driving down the fairway, and when chipping and putting the ball into the cup. The golfer needs to develop a consistent swing when driving with one of the wood clubs. After teeing off and while working one's way along the fairway toward the flag stick on the green, one has to develop one's swing with respect to the other set of golf clubs called the irons. Lastly, after the golfer has landed the golf ball on the green, the final phase is to putt the golf ball into the cup on the green. The whole object of golfing is to do this with the least number of hits on the ball - called strokes.

A typical golf course comprises 18 holes, and is approximately 6,000 yards long. A typical golf course is designed for a par 3 to par 5 per hole depending on the length and difficulty of each hole. In a typical par 4 hole being 300–400 yards long, the golfer will tee off with a driver using one stroke, and then the golfer will use his irons for one or more additional strokes to land the golf ball on the green leaving one or two putting strokes left for the golfer to sink the golf ball into the cup to stay within the assigned par for the hole. Unfortunately, anyone who has ever played golf realizes that there is no room for mistakes when putting the ball while on the green. A slight mis-hit of the ball will result in at least another stroke to sink the ball in the cup on the green. If the golfer has established a good swing to get the ball from the tee-off area to the green, the most important aspect then becomes the golfer's ability to putt the ball accurately to avoid needlessly running up his score for the total game. A skilled golfer (excluding putting) may appear to be a proficient golfer, but if his putting ability is deficient, then his total score for the 18 hole round of play will be far above par. The total score is the objective measure of the golfer's ability to play golf. One third to one half the strokes a typical golfer takes during a round of golf will be on the greens.

All golfers should "warm-up" before beginning their round of golf by hitting several practice golf balls at the driving range and practising one's putting on a practice green adjacent to the golf course. While practicing on the practice green, one should first take long lag putts of 30- to 40-feet to get a feel for the speed of the surface of the practice green that will be similar to the greens encountered on the adjacent golf course. One should then practice medium length putts in the 10- to 15-foot range to find the "exact line" from the ball to the cup. Lastly, short 3 foot putts should be done to practice "pushing" the ball into the cup.

There are several devices on the market that are intended to help, assist and improve the golfer's technique during the putting process. For example U.S. Pat. No. 4,082,286 issued to La Breche, discloses a direction and slope indicating putter head. The putter disclosed in La Breche is intended to indicate to the golfer the slope and direction that the golf ball should be stroked. U.S. Pat. No. 4,179,125 issued to Cone et al. discloses a level indicating putter that is used to indicate the vertical orientation and slope of the green relative to the ball to help the putter to shoot in accordance with the terrain and contour of the green one encounters throughout the typical golf course. Any experienced golfer knows and appreciates that the golf greens are rarely horizontal or even planar and are intentionally sloped, and have mounds and dips and other undulations to make the putting process more difficult in order to challenge the experienced golfer.

The putting stance used by a typical golfer while putting the golf ball is entirely different from the swing when teeing off or when using the irons on the fairway. While addressing the golf ball, the golfer normally holds the grip of the putter firmly with his/her hands to keep the putter head on path throughout the stroke. The stroke is mainly an arm-and-shoulder movement. The swinging action forming the stroke can be described as a pendulum movement. The wrists release on the forward swing, squaring the face of the putter head through impact and keeping it moving straight down the target line. If the swing path wavers, both back and through the pendulum movement, then this will cause off-line putts.

The typical golf putter head that contacts the golf ball has a vertical face and the shaft is angularly positioned relative to the putter head so that the golfer, when properly addressing the ball, will hit the dimpled surface of the golf ball with the planar face of the putter at a vertical tangential position relative to the cup. That is to say, the golfer wants to hit the golf ball square on with the putter head. This can be defined as an imaginary sight line drawn from the cup and passing through the center of the golf ball and having a tangent, or right angle, to this diametral target line. The vertical tangential plane relative to the diametral line should be oriented with a medial vertical plane formed by the golfer standing over and addressing the ball. The stroke used while putting is supposed to hit the surface of the golf ball at a perfect tangential position so that it will proceed in the direction intended by the golfer. Unfortunately, many golfers subconsciously create an arced sweep when bringing back the putter before hitting the ball. It is often so subtle that the average golfer is not aware that he is forming an arc on the ground caused by the putter head going slightly above the grass on the green between the time the golfer pulls back until the golf ball is hit, and the follow through afterward. This arcing motion will of course alter the direction that the golf ball was intended to be hit. Because of this swinging motion, the typical golfer hits the ball in a direction off to the left or right from the exact line previously sighted by him while he was lining up the golf ball with the cup prior to hitting the ball.

SUMMARY AND OPERATION OF THE INVENTION

A golfer's putting aid is demountably secured to the putter head with a rubber band. The invention visually teaches the golfer to keep the putter head at a right angle relative to the sight line the golfer intends to putt the ball along. It is intended to teach the golfer not to twist the putter shaft while putting. The putting aid is a U-shaped bracket formed by a pair of spaced apart parallel fingers extending from a cross brace having a platform. The open ended rectangular cavity formed by the fingers and cross brace is large enough to surround a golf ball lying on the practice green and forms a guideway. There are a pair of spaced apart abutments with anchor posts located on the platform adjacent to the two interior corners of the cavity. The two abutments are vertical and abut against the face of the putter head. The two anchor posts secure the ends of the rubber band which is stretched underneath the cross brace. The stretched rubber band holds both ends of the putter head against the abutments. Both fingers visually exaggerate the angle of the face of the putter relative to the imaginary swing line while practicing one's putting.

Expressed another way, the present invention is generally described as having a U-shaped configuration formed by a rear cross-brace and a pair of spaced apart fingers aligned parallel to each other and at a right angle to the cross brace. The two fingers are referred to as a right alignment projection and a left alignment projection. The bases of the two fingers, or projections, are integral with the cross brace. There are a pair of abutments, or stop members, where the bases of both projections merge with the cross brace for allowing the face of the putter to abut against them. The present invention can be temporarily secured to the head of the putter by having the sole of the putter head rest on the top of the platform formed by the cross brace while the face of the putter head abuts against the two abutment members. There is an endless elastic band, commonly referred to as a rubber band, which wraps around both ends of the putter head to hold the present invention securely onto the putter head. The cross brace has a series of opposed notches to accommodate various sizes and shapes of putter heads currently on the market. A typical putter head can range from a thin blade to a relatively thick and wide putter head.

The present invention is used as a putting aid when the golfer practices his or her putting shots. Once the putter head is secured to the present invention, the golfer makes the ordinary stance to putt the ball as if he were putting the golf ball without the putting aid attached to the putter head. When stroking the ball with a pendulum motion, the face of the putter head is supposed to hit the dimpled surface of the ball squarely head on. If the face of the putter head hits the ball at an offset angle, then the intended direction of the hit ball will be off, and the accuracy of the shot relative to the hole will be affected. In the normal course of events, the golfer sights the ball relative to the cup on the green and will compensate for the speed of the green and the elevation and contour of the green relative to the cup in the area over which the hit ball will travel. Initially, the golfer determines the direction the ball should be hit, taking into consideration the breaking of the ball when necessary. The golfer then determines the imaginary target line along which the golfer intends to hit the ball. The imaginary line must pass through the center of the ball. The face of the putter must be swung along and this imaginary target line directly tangentially so that the ball will be stroked and hit along the imaginary sight line the golfer intended. If the putter head hits the ball at a non-tangential angular position, the ball will roll to the left or to the right of the imaginary target line.

The purpose of the present invention is to teach and assist the golfer to learn how to properly hit the golf ball head on at a true tangent and along the target line. In the normal stance while addressing the ball, the golfer stands at a right angle to the target line already predetermined. When the shaft of the club is swung back in a pendulum motion, the face of the putter should be maintained always at a right-angle position relative to the imaginary target line. If the golfer twists the putter shaft and therefore the putter head during the backswing, then there is a good chance that the putter head will not hit the ball square on. By means of the attached putting aid, the two extending projections, or fingers, will visually indicate to the golfer and emphasize the angle of the face of the club relative to the golf ball before, during, and after the hit. Additionally, during the pendulum swinging motion of the stroke, the pair of moving alignment projections tend to give the impression of a track by the slight fooling of the eye. They give the appearance that the track is longer than the length of both projections and they appear to be up to a foot in length. By practicing one's putting with the present invention, the golfer learns to hold the grip of the club in his hands so that the face of the putter head will always remain at a right angle to the imaginary line of sight or target line. In this way, by doing routine drills, the golfer will learn the mechanics of proper putting so that he will always hit the golf ball squarely head on when putting and thereby reduce any error caused by a mis-hit ball.

The present invention is useful in long, medium, or short putts. In a long putt of 30 to 40 feet, which would be a putt from the edge of the green, the necessity to hit the ball squarely on with the putter is just as important as hitting a medium length ten foot putt, or even a short three foot putt.

DETAILED DESCRIPTION OF THE INVENTION

Figure 1:
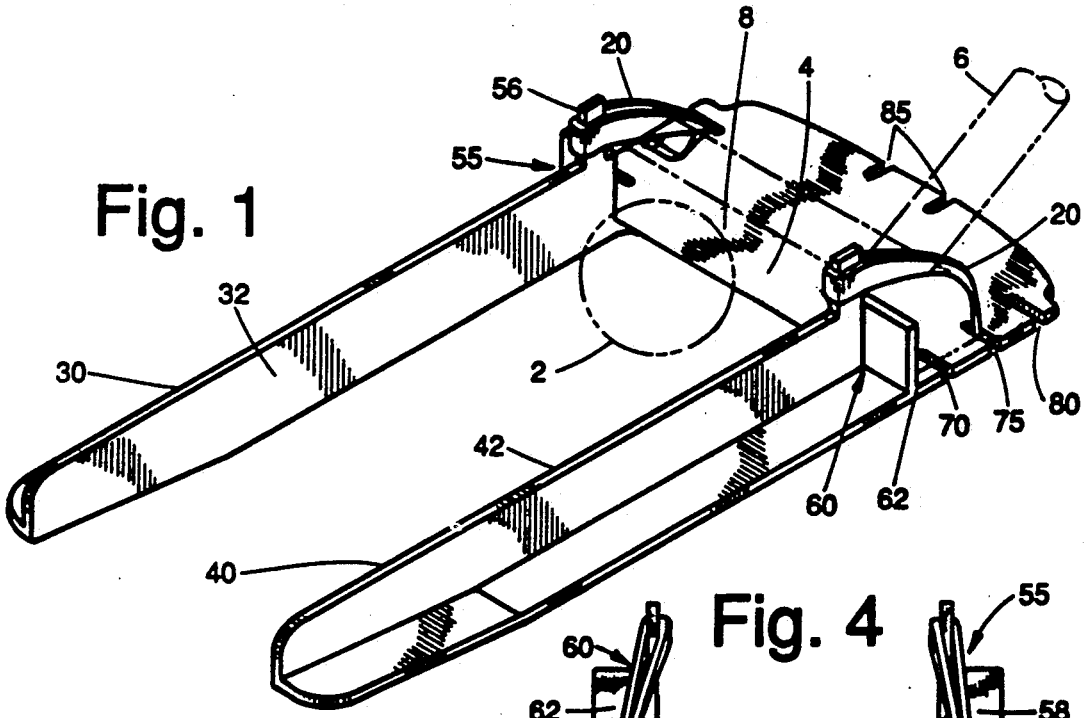
FIG. 1 is a perspective view of the putting aid invention secured to a putter head shown in phantom lines and adjacent to a golf ball also shown in phantom lines.
Figure 4:
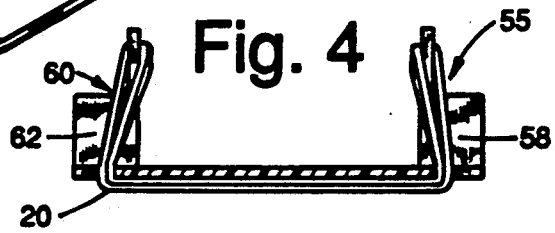
FIG. 4 is a transverse cross-sectional view taken along the lines 4—4 of FIG. 3.
Figure 5:
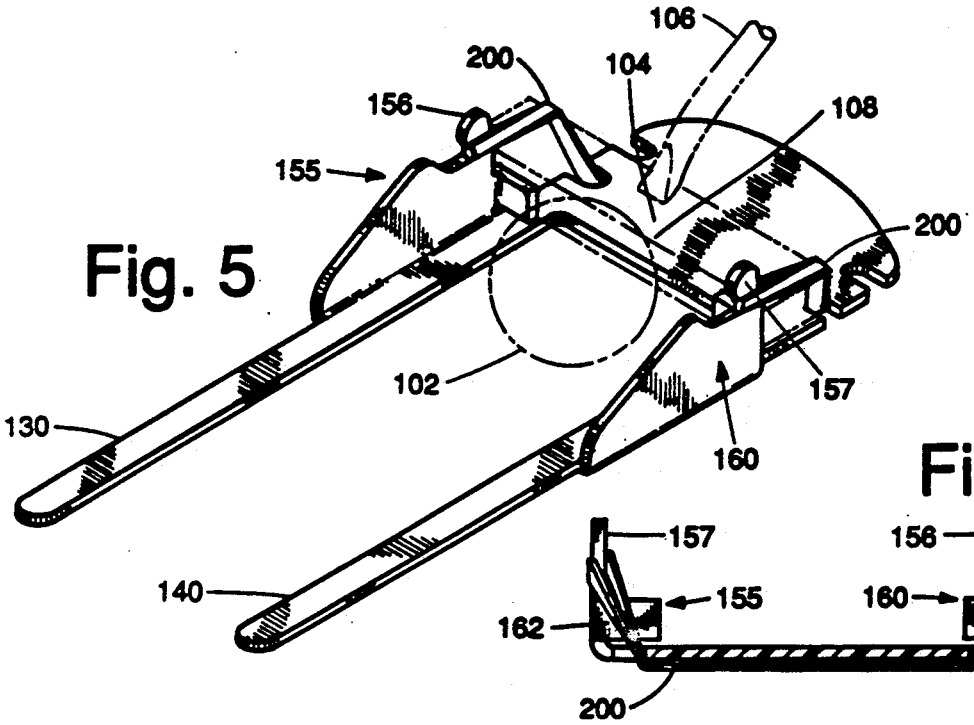
FIG. 5 is a perspective view of an alternate embodiment of the putting aid invention showing the invention secured to a putting head in phantom lines adjacent to a golf ball also illustrated in phantom lines.
Figure 8:
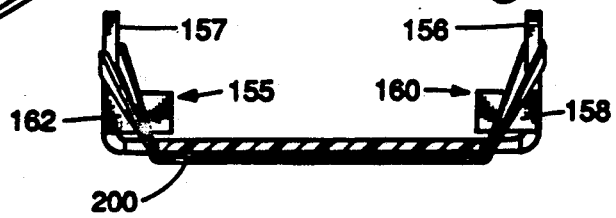
FIG. 8 is a transverse cross-sectional view taken along the lines 8—8 of FIG. 7.
Figure 9:
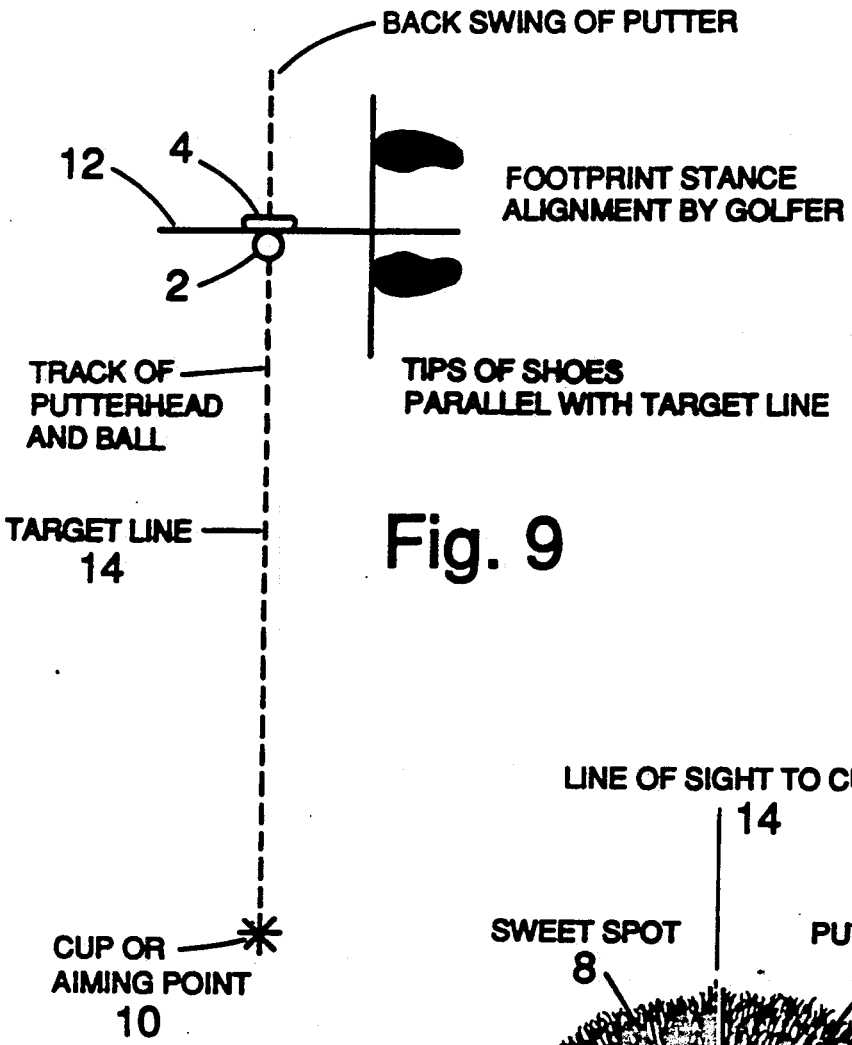
FIG. 9 is a schematic view illustrating the target line from the ball to the cup, the path for the back swing, and the proper stance for the golfer when putting the ball.
Figure 10:
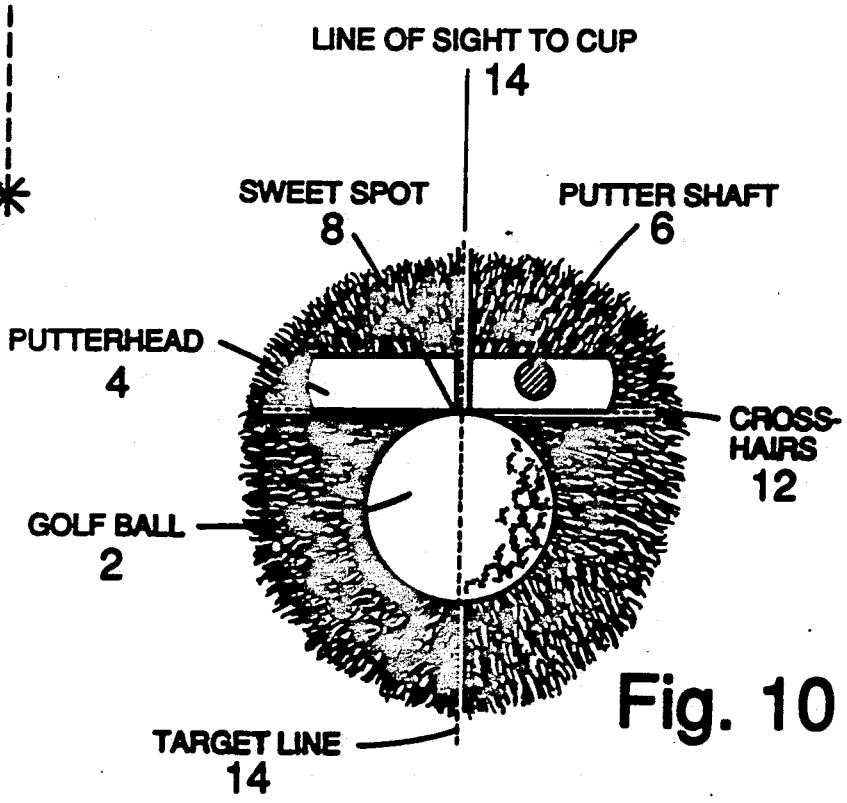
FIG. 10 is a partial view of the green with the ball on the green with the putter head correctly positioned adjacent to the ball at the point of impact during the stroke, and also illustrating the imaginary cross-hairs formed by the face of the putter and the target line.

Referring now to the drawings, there is disclosed in FIG. 1 a perspective view of the putting aid invention. FIG. 5 discloses an alternate embodiment of the invention. The perspective view of FIG. 1 is intended to show the environment in which the invention is practiced. The invention should be envisioned as lying flat on the surface of the grass on the green. The bottom of the invention is flat. The golf ball 2 to be putted is shown in phantom lines and the putter head 4 and a portion of the shaft 6 is also shown in phantom lines illustrating how the invention is secured to the putter head. As stated in the SUMMARY AND OPERATION OF THE INVENTION, all putter heads have a center point referred to as a sweet spot 8. The sweet spot 8 has to be lined up along the line of sight from the cup to the ball itself. FIG. 9 illustrates a diagram showing the line of sight or target line 14 drawn from the cup 10 to the ball 2 and an imaginary cross hair 12 formed at right angles to the line 14 to the cup 10. FIG. 10 shows a close-up view of the putter head 4 and aligned with the golf ball 2 as illustrated in FIG. 9. Even if the portion of the green to be traversed after hitting the ball is horizontal or inclined, the golfer must still hit the golf ball squarely head-on with his putter. Failure to hit the golf ball squarely head-on will result in the ball traveling to the right or left of the intended line of sight, which was predetermined by the golfer while sizing up the green. There are many factors that the golfer must take into account when deciding on the path that the golf ball should be hit. For example, the speed of the green, the type and texture of the grass on the green, and whether the putt is uphill or downhill. Even so, the mechanics of hitting the golf ball square on must be repeatable and rhythmic in order to provide consistency during the putting process.

Figure 6:
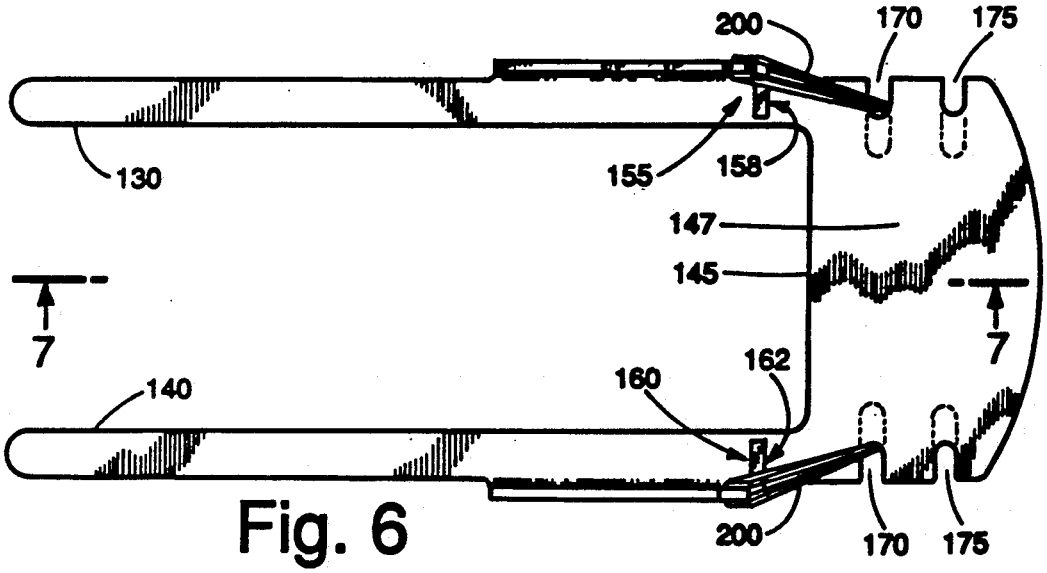
FIG. 6 is a top plan view of the alternate embodiment.
Figure 7:
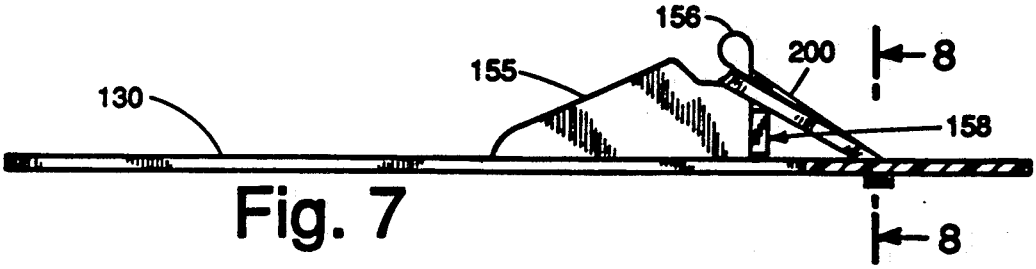
FIG. 7 is a longitudinal cross sectional view taken along the lines 7—7 of FIG. 6.

The putting aid invention is secured to the putter head by means of a rubber band 20 illustrated in FIGS. 1 through 8 and the number 200 in FIGS. 5 through 7. In the preferred embodiment, the invention can be described as having a generally U-shaped configuration formed by a pair of projections 30 and 40 spaced apart and parallel to each other and extending from a generally right angular cross brace 45. The cross brace forms a platform 47. The two projection members 30 and 40 and cross brace create a rectangular-shaped opening 50 with the open end opposite the cross brace 45. There are a pair of abutment means 55 and 60 formed where the two projections 30 and 40 merge with the cross brace 45. Both abutment means are L-shaped in cross section. The abutment means have vertical faces 58 and 62 on their backsides so that the face of the putter head will be vertical to the surface on the green when it is attached to the invention. There are divergent varieties of configurations in putter heads ranging from a thin light blade to a bulky, heavy putter head. The putter shafts are angled at various diverse angles relative to the sole of the putter head. This is referred to as the lie of the putter. Even so, all putter heads generally have one thing in common and that is that the putter head, as the sole lies naturally adjacent to the ball, always has the face of the putter head in a vertical plane relative to the surface on the green. Since the face of the putter head is always vertical, both faces 58 and 62 of the two abutment means 55 and 60 also must be vertical to accommodate the putter head 8.

The cross brace includes a series of laterally spaced notches 70, 75, 80 on either side of the cross brace 45. These notches are intended to accommodate the previously mentioned diverse configurations of putter heads. The putter illustrated in FIG. 1 has a medium thickness and accordingly the elastic rubber band 20 is strung through the second or middle pair of notches 75 The first pair of notches 70 will accommodate a putter head having a relatively narrow blade. The third pair of notches 80 will accommodate a putter head having a relatively wide putter head. The three pairs of notches are sufficient to cover the range of most putter sizes. In the unusual event where the putter head is extremely wide, then there is a pair of rear notches 85 cut into the cross brace 45 where the rubber band 20 would loop through the pair of rear notches and the two ends of the rubber band would be secured to the two posts 56 and 57 rising above the two abutment means 55 and 60. The two posts 56 and 58 are defined as each being a component of and included as part of the term abutment means.

The two spaced projections 30 and 40 can also be described as a right finger and a left finger. The main purpose of the two fingers is to visually indicate to the golfer that he or she is hitting the golf ball squarely with the face of the putter head as shown in FIG. 10. If the face of the putter head hits the ball other than square on, the resulting mis-hit ball will travel either to the left or to the right of the intended line of sight as shown in FIG. 9. This will undoubtedly result in the golfer having to use at least another stroke to sink the ball in the cup. As shown in FIG. 9 the golfer initially aims the putter with the ball much as one would aim a rifle at the cup using the cup as a target. The next step then is to align the body so that both feet are in a line parallel with the target line chosen by the golfer. This is known in golfing parlance as the stance and addressing the ball prior to hitting the ball. There are many variations among experienced golfers in the stance used by them. For the purposes of the discussion herein it will be presumed that the golfer will use the more traditional arm-shoulder movement with a slight twisting of the wrists during the follow-through. Most golf pros advise a golfer to make an arm-shoulder movement much as a pendulum would swing back and forth while holding the grip on the shaft relatively tight to prevent the shaft from twisting during the swing. It is also recommended by most golf pros that the backswing be relatively short and that the follow-through forward swing be an accelerating process from the backswing rather than a decelerating process. The golfer is also supposed to keep the face of the putter head always at a right angle to the imaginary line of sight shown in FIG. 9. Many golfers have the bad habit of rotating or twisting the putter shaft during the back-swing and even arcing the putter head during this back-swing so that in effect the golfer hits the ball with an arcing motion relative to the ground. Even if the golfer hits the golf ball square on during this incorrect arcing motion, the ball will still be deflected to the left or the right of the intended target line. Accordingly, the golfer always wants to keep the putter face at a right angle to and above the imaginary target line behind the ball. During the forward swing prior to hitting the ball, the face of the putter remains at a right angle and goes along this predetermined chute or imaginary swath that the putter head will create during the putting stroke. The golfer may be placated into thinking that the putter head is always at right angles to the target line during the back swing when in fact this is not the case at all. By attaching the putting aid invention to the putter head, the golfer can go through the putting drills on the practice green and develop the mechanics of swinging the putter properly. The putting aid invention visually indicates to the golfer the angle of the putter face relative to the golf ball. The left and right alignment projection members 30 and 40, or fingers, visually indicate to the golfer whether or not the stroke is correct. As the golfer makes his pendulum motion swinging the putter back and forth, he can adjust his grip on the shaft so that the club is always at a right angle to the target line and proceeds directly along the swath above the imaginary target line.

FIGS. 5 through 8 illustrate an alternate embodiment of the putting aid invention. FIG. 5 illustrates a perspective view of the invention with the putter head 104 and a portion of the putter shaft 106 shown in hatched lines along with a golf ball 102 properly positioned adjacent to the sweet spot 108 on the putter head 104. There are illustrated the two flat projections 130 and 140 spaced apart and parallel to each other and a rear cross brace 145 forming a rear platform 147 upon which the sole of the putter head will rest. There are a pair of mirror image abutment means 155 and 160 illustrated as abutments against which the vertical face of the putter face can temporarily touch. Both abutments have cutaway indented portions forming posts 156 and 157 to which both ends of a rubber band 200 can be secured. Each abutment has a face 158 and 162 respectively. There are illustrated two pairs of lateral notches 170 and 175 to accommodate the various configurations of putters available and on the market. The path of the stretched elastic rubber band is underneath the platform between the two notches. From the two notches, both ends of the rubber band are secured to the two posts 156 and 157 on the abutments 155 and 160 to hold the rubber band in place. The length of the path traversed by the rubber band when it is positioned is slightly longer than the length of the unstretched rubber band. In this way, the rubber band will always remain slightly tensioned and will not fall off even when the putter head is not attached to the putting aid invention. The putting aid invention can be quickly secured to the putter head by having the golfer position both ends of the putter head adjacent to the abutment faces and stretching the elastic band over the body of the putter head to allow the elastic band to hold the putter onto the invention.

During the practice drill on the practice green the golfer will use the putter in combination with the putting aid invention and will practice his pendulum-like putting swings to assist and teach the golfer to maintain the face of the putter along the target line during the backswing and also through the follow-through forward accelerating motion during the putting process.

This putting aid invention could have different configurations other than those illustrated and described herein. For the sake of simple and economical fabrication, the invention is made of a one piece high density plastic injection molding process. However, the invention could be made from separate complementary pieces and glued or otherwise secured together to form the basic structure of the invention. Additionally, the elastic rubber band is an economical component forming part of the invention. However, the securement means to secure the putter head temporarily to the invention could be brought about by a variety of other structures. For example, there could be embedded magnetic strips around the abutment face and/or along the platform so that the magnetic interaction between the putter head and the magnetic strips would hold the putting aid to the putter head. There could also be an elastic flexible boot integrally formed in the platform area such that the putter head could slip into the boot and likewise hold the invention to the putter head. Also, there could be clamps on the platform to hold the putter to the putting aid invention.

Figure 2:
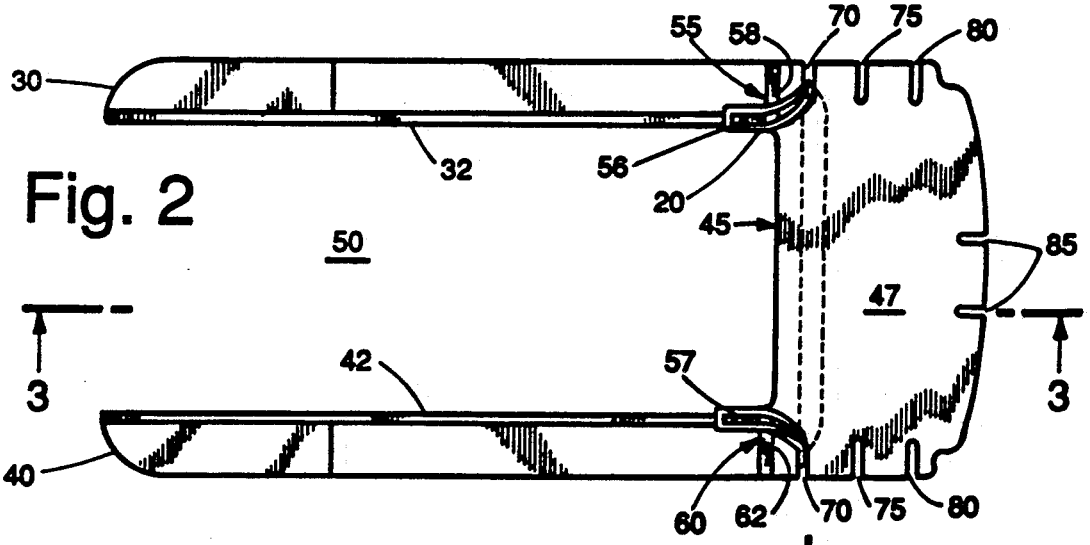
FIG. 2 is a top plan view of the invention.
Figure 3:
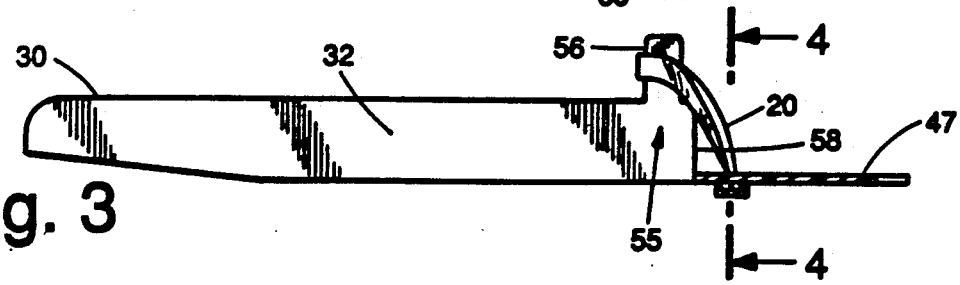
FIG. 3 is a longitudinal cross-sectional view taken along the lines 3—3 of FIG. 2.

FIG. 2 illustrates the top plan view of the invention and how the invention would appear to the golfer when he would be addressing the golf ball. In FIG. 2 the putter head is not shown. However, the elastic band 20 is in place and as one can see, one end of the band is attached to the post 56 at the right abutment means 55, the body of the rubber band is hooked into the first notch 70 and stretched underneath and transversely across the cross brace 45. The left end of the rubber band emerges through the other lateral notch 70 and is secured to the left post 57.

The left projection member 40 has an upright rib 42 extending from the left abutment means 60 to increase the rigidity of the left projection member. Likewise, the right projection member 30 also has an upright rib 32 to increase the rigidity of the right projection member. Both projection members 30 and 40 are L-shaped in cross section. Also there are portions of the abutment means illustrated as abutments that are at right angles to both upright ribs to also increase the rigidity of the invention itself. Both abutment means 55 and 60 are positioned at the closed corners of the rectangular opening formed by the cross brace and the two projection members.

In the preferred embodiment, both tips of both projections are angularly cut upwardly five degrees on their bottoms to minimize any catching or contact with the surface of the green while practicing with the invention. As one is well aware of during the backswing pendulum motion the two tips will arc downwardly relative to the vertical plane in which the golfer's hands are moving and the two tips could easily catch themselves on the grass. Again, the purpose of the two angularly cut tips is to minimize any interference with the surface of the green.

Whereas the present invention has been shown and described herein in what is conceived to be the best mode contemplated, it is recognized that departures may be made therefrom within the scope of the invention which is therefore not to be limited to the details disclosed herein but is to be afforded the full scope of the invention.

What is claimed is:

1. A golf ball putting aid comprising:

a generally U-shaped bracket having a cross brace and two projection s positioned in a spaced parallel relationship with each other and at a generally right angular position to said cross brace;

a generally U-shaped opening formed by said cross brace and said two projections, and having an open end opposite that to said cross brace;

vertical abutment means positioned on said cross brace for engaging the face of a putter which is demountably secured to said putting aid;

an elastic securement means for temporarily securing the putter head to said putting aid whereby when said putting aid is mounted to the golfer's putter and while stroking the golf ball during the putting process, said spaced projections visually indicate to the golfer how squarely the golfer is hitting the golf ball with the putter.

2. The golf ball putting aid as recited in claim including:

a planar platform integral with said cross brace for allowing the sole of the putter head to rest on while the face of the putter head is positioned against said abutment means.

3. The golf ball putting aid as recited in claim 2 including:

a plurality of opposed lateral notches on said platform for allowing said elastic securement means to be strung between said notches.

4. The golf ball putting aid as recited in claim 1 wherein said cross brace and said projections form a planar bottom.

5. The golf ball putting aid as recited in claim wherein said tips of said projections are cutaway in an upward angular fashion for minimizing catching the green while using said device while practicing one's putting.

6. The golf ball putting aid as recited in claim including:

anchor means adjacent to said abutment means for allowing said securement means to be demountably secured to said putting aid.

7. A golf ball putting aid comprising:

a generally U-shaped bracket having a horizontal support member and two fingers positioned in a spaced parallel relationship with each other and at a generally right angular position to said horizontal support member;

a generally U-shaped opening formed by said horizontal support member and said two fingers, and having an open end opposite to said horizontal support member;

vertical abutment means positioned on said horizontal support member for engaging the face of a putter which is demountably secured to said putting aid;

an elastic securement means for temporarily securing the putter head to said putting aid whereby when said putting aid is mounted to the golfer's putter, while stroking the golf ball during the putting process, said spaced fingers visually indicate to the golfer how squarely the golfer is hitting the golf ball with the putter.

8. The golf ball putting aid as recited in claim 7 including:

a planar platform integral with said horizontal support member for allowing the sole of the putter head to rest on while the face of the putter head is positioned against said abutment means.

9. The golf ball putting aid as recited in claim 8 including:

a plurality of opposed lateral notches on said platform for allowing said elastic securement means to be strung between said notches.

10. The golf ball putting aid as recited in claim 7 wherein said horizontal support member and said fingers form a generally planar bottom.

11. The golf ball putting aid as recited in claim 7 wherein said tips of said fingers are cutaway in an upward angular fashion for minimizing catching the green while using said device while practicing one's putting.

12. The golf ball putting aid as recited in claim 7 including:

anchor means adjacent to said abutment means for allowing said securement means to be demountably secured to said putting aid.

* * * * *